US008002111B2

(12) United States Patent
Kollman et al.

(10) Patent No.: US 8,002,111 B2
(45) Date of Patent: Aug. 23, 2011

(54) KIT AND METHOD FOR MAKING A SHUTTER

(75) Inventors: Michael Kollman, Madison, WI (US); Nicholas J. Schultz, Marshall, WI (US)

(73) Assignee: Lumino, Inc., Madison, WI (US)

( * ) Notice: Subject to any disclaimer, the term of this patent is extended or adjusted under 35 U.S.C. 154(b) by 1080 days.

(21) Appl. No.: 11/807,516

(22) Filed: May 29, 2007

(65) Prior Publication Data

US 2008/0295406 A1 Dec. 4, 2008

(51) Int. Cl.
*B65D 85/46* (2006.01)

(52) U.S. Cl. ..... 206/321; 49/74.1

(58) Field of Classification Search ..... 206/321; 49/74.1, 506

See application file for complete search history.

(56) References Cited

U.S. PATENT DOCUMENTS 5,339,591 A * 8/1994 Underdahl ..... 52/473
5,490,353 A * 2/1996 McLaughlin ..... 49/64
5,778,598 A * 7/1998 Ohanesian ..... 49/74.1
5,887,386 A * 3/1999 Alexanian et al. ..... 49/403
6,263,632 B1 * 7/2001 Cadorette ..... 52/473
6,314,680 B1 * 11/2001 Buckwalter et al. ..... 49/82.1
6,474,034 B1 11/2002 Dronigi
6,622,433 B2 * 9/2003 Blachley ..... 49/506
6,732,475 B1 5/2004 Lee
6,837,003 B2 1/2005 Nien
2003/0136053 A1 * 7/2003 Norbert ..... 49/74.1

* cited by examiner

*Primary Examiner* — Mickey Yu
*Assistant Examiner* — Jenine M Pagan
(74) *Attorney, Agent, or Firm* — Buchanan Ingersoll & Rooney PC

(57) ABSTRACT

A kit containing components which can be assembled into a shutter panel includes a header, a footer, a plurality of brackets, a first stile, a second stile, a plurality of louvers. One embodiment also contains a jig to align the bracket with the header or footer for attachment. Each bracket is sized and configured to be connected to an end of the header or footer. The stiles each have a longitudinal channel which enables the stiles to be fitted over at least one of the brackets. The jig has a mouth sized to receive an end of the footer or header and a cavity adjacent the mouth such that a user of the jig can place one end of a bracket in the cavity and the other end of the header or footer in the mouth. The kit may be packaged in two packs. One pack contains a header, a footer and a plurality of brackets. The second pack contains mounting frame pieces, at least one first stile, at least one second stile, a plurality of louvers, louver strips, a tilt rod, screws and other hardware which can be assembled into a shutter panel having the desired dimensions. The header, footer, stiles and brackets are provided to a retailer in standard sizes. The retailer may then trim these components as required to create a shutter having the desired dimensions.

17 Claims, 5 Drawing Sheets

FIG. 6
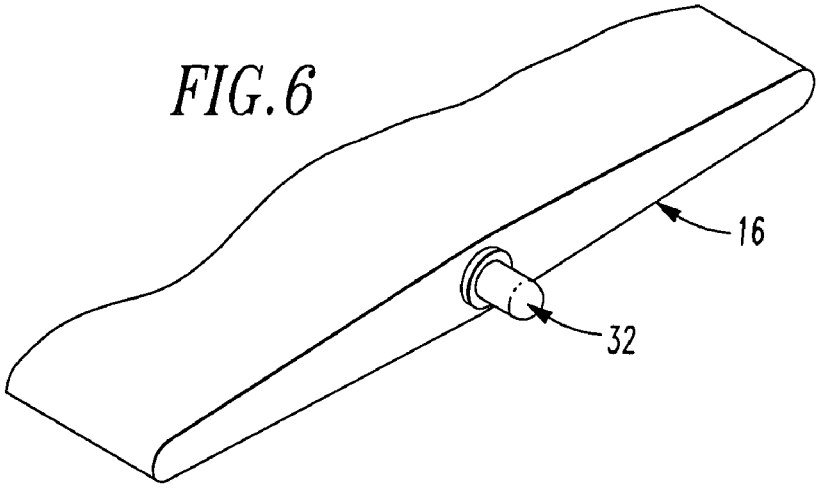
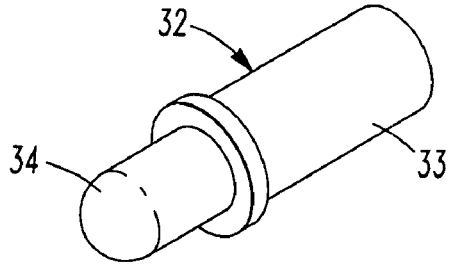
FIG. 7
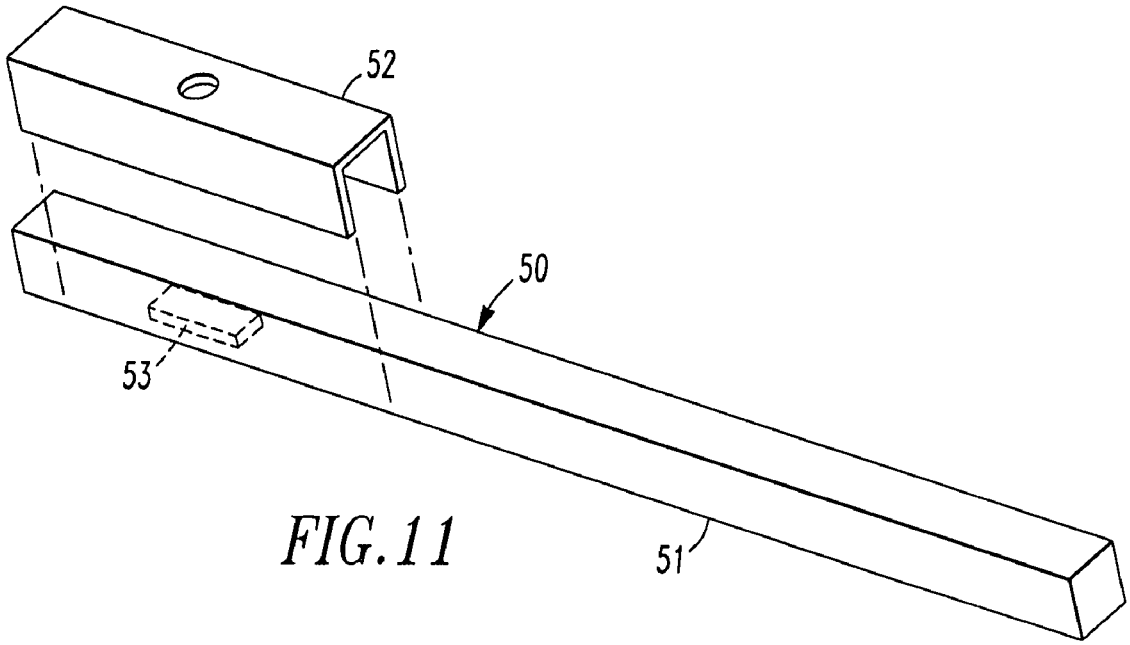
FIG. 11

KIT AND METHOD FOR MAKING A SHUTTER

FIELD OF INVENTION

The present invention relates to shutters used on windows and methods for making shutters and shutter panels.

BACKGROUND OF THE INVENTION

A conventional shutter used on windows can be one or more panels, each panel having a frame, a set of louvers and a control rod that can be manipulated by a user to tilt the louvers. The frame is typically a rectangular frame that defines an opening in which the louvers are placed. Part of the top of the frame is defined by a header and part of the bottom of the frame is defined by a footer. Stiles create the sides of the frame. Each stile normally extends from adjacent an end of the footer to adjacent an end of the header. A series of louvers extend between the stiles in most shutters. However, in some shutter panels the louvers extend between the header and the footer. The louvers are arranged in series such that the tilt axis of each louver runs from one stile to the other stile. Shutters may be mounted adjacent a window or within the frame of a window. Sometimes shutter panels are carried on tracks.

Shutters which are used as window coverings may be one or more shutter panels. Usually there are two shutter panels placed side by side. Each shutter panel is attached by hinges to a frame. Typically the frame includes spaced apart sides to which the hinges are attached. The frame can include a bottom strip and a top strip extending between the sides, which serves as a light block and is sometimes called a light block strip. The bottom strip and the footer or bottom of one stile may have magnets for keeping the shutter panel closed.

Shutter panels are typically sold by retailers or by manufacturers in custom made sizes through a special order program. Because shutters panels are made to fit an exact window opening in terms of both width and height, it is very difficult for retailers and manufacturers to offer shutter panels in standard sizes. In most instances where standard size shutter panels have been sold and used a frame and shims were also been provided. The fit is made by adding shims or spacers between the frame and the sides of the window opening. However, frame pieces installed with spacers or shims do not have a clean, professional appearance and are disfavored. Therefore, in a most homes and offices, the shutters are custom made to fit within a particular window opening. The dimensions of the window opening and desired installation location of the shutter may be provided by the customer, but are often measured by a professional. Custom shutter panels sized to fit within the opening or openings having the dimensions provided are made at the factory and shipped to the customer or to a window covering professional for installation. Several days and even weeks may pass between the time the shutter panel or panels are ordered and when the shutter is received for installation.

The window covering industry has developed cut-down programs for Venetian blinds, vertical blinds, pleated shades and cellular shades. Such programs provide the retailer with several standard size blinds and a machine which can be used to shorten the width of the blind to any desired width. A utility knife or scissors often is used to shorten the length of the blind. Consequently, a home owner can take his window measurements to a retailer having a cut-down program, select among several styles of Venetian blinds, vertical blinds, pleated shades and cellular shades, and have the selected blind cut to size while the customer waits. The cut-down process typically takes only a few minutes. So a buyer of Venetian blinds, vertical blinds, pleated shades or cellular shades can take home a custom size blind the same days he or she selects the product. For this reason cut-down programs have been very popular among buyers and sellers of window coverings. To date, there have been no cut-down programs for shutters. This is true even though shutters have become more popular in recent years. The popularity of cut-down programs for blinds, coupled with the increasing popularity of shutters for window coverings, demonstrate the need for a shutter that can be offered in a cut-down program and methods for making and assembling such a shutter.

SUMMARY OF THE INVENTION

We provide a shutter and methods for making and assembling shutter panels which enable a retailer to expand the cut-down programs currently available for blinds to encompass shutters. The present shutter and methods of making and assembling the shutter make it possible for a homeowner to order, assemble and install shutters in a single day.

Rather than providing finished, standard size, shutter panels to the retailer we provide the retailer sets of shutter components in standard sizes. Those components can be cut by the retailer and assembled by the customer to make a shutter panel in almost any size that a homeowner may desire. When the buyer leaves the store he or she will have two packs in separate boxes or other packaging, each pack containing some of the components required to make at least one shutter panel. One pack contains a header, a footer and a plurality of brackets. The second pack contains mounting frame pieces, at least one a first stile, at least one second stile, a plurality of louvers, louver strips, a tilt rod, screws and other hardware which can be assembled into a shutter panel having the desired dimensions. Of course, the two packs when sold together could be considered to be a single kit. We also provide a jig in the kit which enables the customer to readily align each bracket with the header or footer and easily connect them together. Each bracket is sized and configured to be connected to an end of the header or footer. The jig fits over one end of the header or footer and receives a bracket, thereby aligning the components for attachment. Then each screw of at least a pair of screws is positioned over a respective hole in the bracket and driven through the bracket and into the header or footer holding these two components together. After the screws are in place the jig is removed and ready for use on the next joint.

The stiles each have a longitudinal channel that is sized and configured to receive at least a portion of at least one of the brackets. The stiles are connected to the header and footer by sliding them over and onto the brackets which have been attached to the header and footer. Each louver is sized and configured to be connected to and between the first and second stiles. This may be done by attachment to the brackets or to louver strips within the stiles.

The jig has a body configured to define a mouth sized to receive an end of the header or footer as selected by a user and a cavity adjacent the mouth. The cavity is configured to receive one end of one of the brackets while one end of the header or footer is in the mouth. When so positioned the bracket is attached to the header or footer that is in the mouth. One sidewall portion of the jig may have at least one screw hole positioned to enable a user to drive a screw through the bracket in the cavity and into the header or footer in the mouth.

We prefer to provide a spring loaded pin on at least one end of every louver. The spring loaded pin has a tubular body portion containing a spring and a retractable portion that is positioned adjacent the spring such that the retractable portion is able to move entirely into the tubular body portion. The tubular body portion or the retractable body portion or both may be tapered to have a smaller diameter at its distal end.

We also prefer to provide a light block strip which is included with our header and footer. The light block strip can have a length that is not greater than the length of the footer plus the widths of the stiles. We prefer that the light block strip have an elongated body that has a length equal to the length of the footer and an elongated U-shaped member sized to fit over the elongated body. The U-shaped member has a length not smaller than the sum of the widths of the stiles and preferably is longer. At least one magnet can be attached to the light block strip to provide a magnetic catch to hold the shutter panel in a closed position. We prefer to use a magnetic strip placed on the elongated U-shaped member.

We prefer to provide a tilt rod that is configured for attachment to the plurality of louvers. The tilt rod can have a first elongated body that has a slot and a second elongated body. At least a portion of the second elongated body is sized and configured to fit within the slot of the first elongated body. The second elongated body has a plurality of hooks. Each hook is sized, positioned, and configured to receive a portion of one of the louvers of the plurality of louvers. That portion of the louvers may be a staple or loop sized and positioned to receive one of the hooks in the second elongated body.

The stiles may be wrapped together in a manner so that both stiles can be cut simultaneously. Similarly, the header and footer can be wrapped together in a manner so that both of these components can be cut simultaneously. If a light block strip is provided, that strip can be wrapped with the header and footer. When so wrapped the light block strip will to be cut at the same time and to the same length as the header and footer.

We also provide a method of selling shutters that includes providing a retailer sets of unassembled shutter components in several standard sizes. These components are sold to a customer in kit form. Oftentimes the header and footer and the stiles will have been cut to shorten its longer dimension to a desired length before being combined into the shutter kit.

Other details, objects, and advantages of the invention will become apparent as the following description of certain present preferred embodiments thereof proceeds.

BRIEF DESCRIPTION OF THE DRAWINGS

In the accompanying drawings we have shown certain present preferred embodiments of our kit and method for making shutters in which:

FIG. 6 is a fragmentary view of a present preferred embodiment of a louver that can be included in our kit.

FIG. 7 is a perspective view of a present preferred embodiment of a pin that can be connected to an end of the louver shown in FIG. 6.

FIG. 11 is an exploded view of a present preferred embodiment of a light block strip that can be included in our kit.

DETAILED DESCRIPTION OF PRESENT PREFERRED EMBODIMENTS

We provide the retailer sets of shutter components in standard sizes. These shutter components include headers, footers, brackets, stiles, louvers, louver strips, tilt rods, screws and other hardware which can be assembled into a shutter panel. The headers, footers, stiles and louvers are provided to the retailers in several selected lengths and widths, wherein length refers to the longest dimension. A customer desiring to purchase a shutter will give the sales associate the dimensions of the window or other location where the shutter will be installed. The sales associate will select two kits or packs of shutter components which can be cut down and assembled into a shutter of the desired dimensions. One kit or pack contains a header, a footer and a plurality of brackets. The second kit or pack contains mounting frame pieces, at least one first stile, at least one second stile, a plurality of louvers, louver strips, a tilt rod, screws and other hardware which can be assembled into a shutter panel having the desired dimensions. The sales associate will shorten those components which must be shortened to achieve a shutter of the dimensions provided by the customer. After sizing all components will be placed back in their pack and can be boxed, wrapped or otherwise held together, thereby creating a complete kit for making one or more shutter panels. Instructions for assembly are also placed in the kit or given separately to the customer. We also prefer to include in one of the packs a jig for use in attaching each bracket to the end of the footer or header.

Figure 1:
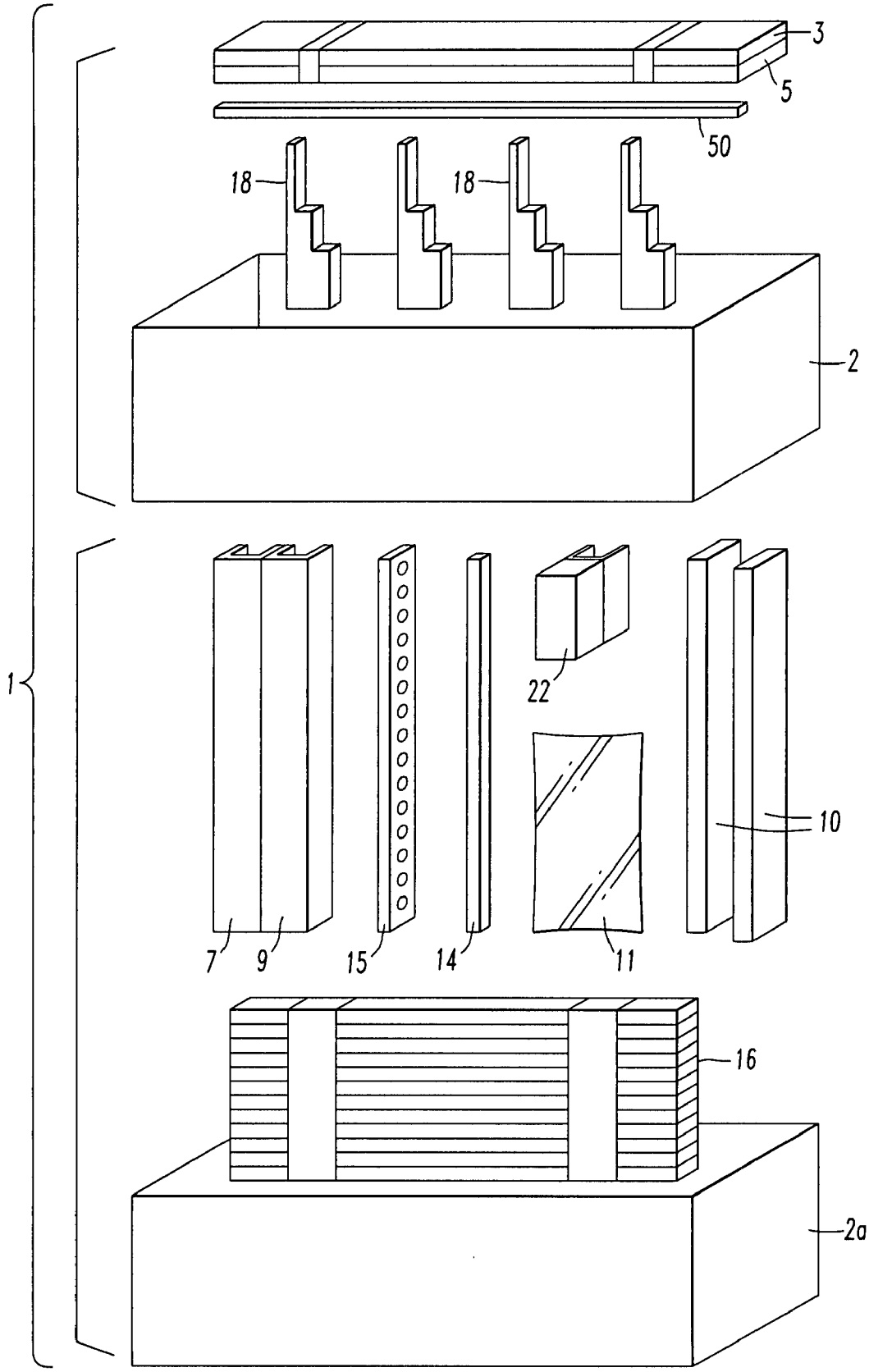
FIG. 1 is an exploded view of a present preferred embodiment of our kit which contains a header, footer and bracket in one pack and a second pack containing mounting frame pieces, at least one a first stile, at least one second stile, a plurality of louvers, louver strips, a tilt rod, screws and other hardware required to assemble and install a shutter panel.

Referring to FIG. 1, a first embodiment 1 of our kit includes a first box 2 that is packed with a header 3, a footer 5 and brackets 18. This box may also contain light block strips, such as the strip shown in FIG. 11. The second box 2*a* contains plurality of louvers 16, louver strips 15, a tilt rod 14, a first stile 7, a second stile 9, a jig 22, two frame members 10 and a bag 11 containing screws and other hardware required to assemble the components into a shutter panel. Assembly instructions may also be in the bag. The header 3 and footer 5 preferably are wrapped together so that they can be cut at the same time. Similarly, the stiles 7 and 9, as well as the louver strips, can be wrapped together so they can be trimmed together. Trimming can be done using a blade or saw of the type commonly used to trim blinds.

The complete kit many be assembled by the retailer who selects the appropriate components from boxes or bins of like components. However, we prefer to provide the retailer two kits or packs. One such pack preferably contains the components of box 2 and the second pack contains the components of box 2*a*. We prefer to provide to the retailer a first set of packs containing a header, a footer, brackets and light strips and a second set of packs containing the same components while the width of the header and footer being different between the two sets. The retailer selects a pack containing a header, footer, brackets and light block strips and a second pack which has stiles, frame pieces, louvers, louver strips, a tilt rod and hardware. Then the retailer removes and trims those of the stiles, header, footer, louvers, louver strips and light block strips which must be shortened and replaces the cut-down components into the pack from which they were removed. The selected packs are then sold to the customer as a complete kit for making a shutter panel. Preferably the cuts will be made by the retailer at the time of sale. However, the kit could be sold with instructions that enable the customer to trim the components. While we envision that all trimming of components will be done by the retailer, a customer may choose to buy the kit as delivered to the retailer and cut the standard size components himself.

We prefer to provide at least two different sets of standard headers and footers. Each set of headers and footers can have the header and footer wrapped together so they can be cut simultaneously by a cut down machine, saw or other cutting mechanism. The length or width of the header and footer in one set is different from the length or width of the header and footer in other available sets. Preferably, the widths of the footer and header in one set are 3.375 inches and the widths of the header and footer in the second set is 3.875 inches. In a shutter made from a present preferred embodiment of our kit each louver covers a two inch space and may overlap an adjacent louver by as much as one half inch when the louvers are closed. Consequently removing a louver from a panel to make a shorter panel creates a two inch gap. Some of that gap is filed when the stiles are shortened. Another portion of that gap can be filled by changing the overlap of the louvers. Adjusting the overlap in our system can only provide one inch of coverage. The remaining space to be covered will be less than one inch, but can be close to one inch. We can cover that additional space by choosing either the footer and header with the 3.375 inch widths or the header and footer with the 3.875 inch widths. If the height of the finished shutter panel is an even number of inches then the header and footer with the 3.875 inch widths are used. When the height of the finished shutter panel is an odd number of inches then the header and footer with the 3.375 inch widths are used. After a customer has provided the sales associate with the measurements of his or her window, the retailer may select the appropriate sized header and footer set that matches the size of the window opening dimensions provided by the customer. It should be appreciated that various other sets of headers and footers may also be provided that have differing dimensions or aesthetic effects as well and may require the retailer to select one of these other sets based upon selection and window opening dimensions provided by a customer.

Preferably, the louvers, stiles, louver strips, tilt rod, and frame members are wrapped so that all these components may be cut down by a minimum amount of cutting passes with a cutting mechanism. For example, we prefer to wrap the stiles 7 and 9 together so both stiles may be cut simultaneously, as shown in FIG. 1. We also prefer to wrap the louvers 16 together and the frame members 10 together so each respective set of components may be cut down simultaneously by the retailer to fit within the window opening dimensions provided by the customer.

It should be appreciated that different components may also be wrapped to further reduce the number of cutting passes needed to cut down the various shutter components. For example, the stiles 7 and 9 and outer frame members 10 may be wrapped together to permit a retailer to cut down the length of both the stiles 7, 9 and frame members 10 at the same time. Furthermore, the tilt rod and louver strips may also be wrapped with the stiles to reduce cuts.

The header 3, footer 5, and louvers 16 may also be wrapped together so they can be cut down at the same time. The louvers should be wrapped together or otherwise manipulated when wrapped with the header and footer such that the louvers are cut to be slightly shorter than the header and footer so the louvers will fit inside the shutter panel that is formed by the shutter components. Such manipulation could be provided by manually moving the louvers or by moving the wrapped header, footer, and louvers against a back stop of a cut down machines that is sized and configured to engage the louvers such that the louvers are cut down more than the header and footer. Preferably, the louvers are cut 0.125 inches shorter than the header or footer.

The configuration and size of the shutter components permit a retailer to cut down standard sized shutter components based on the standard lengths of those components. It is contemplated that the various shutter components will be available in at least two different standard lengths that will then be capable of being cut down to fit numerous different window opening dimensions. Preferably, the retailer will cut down the shutter components at the time the customer purchases them. After the shutter components have been cut down by the retailer, a customer may take home the trimmed shutter components together with the other parts needed to construct a shutter panel. Each kit may contain sufficient parts to make one or more shutter panels. At home the customer can assemble the components in each kit to form one or more shutter panels, and then install the shutter panel or panels in the window opening.

Figure 2:
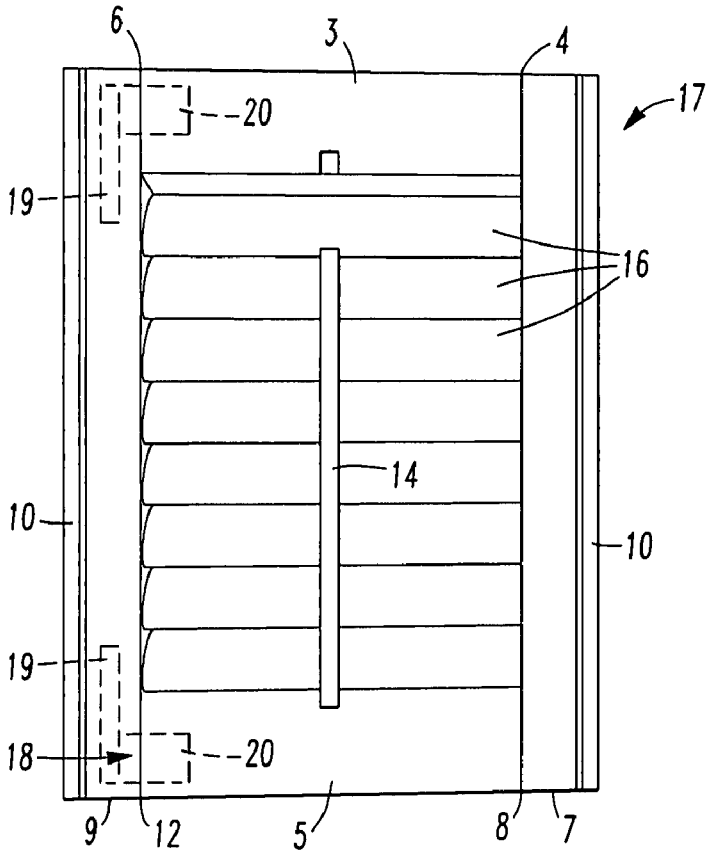
FIG. 2 is a perspective view of a shutter assembled from the components in the first embodiment of our kit.

Referring to FIG. 2, an assembled shutter 17 is illustrated that is formed with the shutter components included in the first embodiment 1 of our kit. The shutter 17 has a header 3, stile 7 attached to one end 4 of the header 3 and stile 9 attached to the opposite end 6 of the header 3. Stile 7 extends from end 4 of the header 3 to end 8 of the footer 5. Stile 9 extends from end 6 of the header 3 to end 12 of the footer. Louvers 16 are attached between stiles 7 and 9 to a louver strip (not shown) within each stile. An outer frame member 10 is attached adjacent to a respective stile. This outer frame member is attached to the window frame or the sides of the opening in which the shutter is placed. The frames members are not needed if the shutter panels are attached directly to the window frame.

Figure 3:
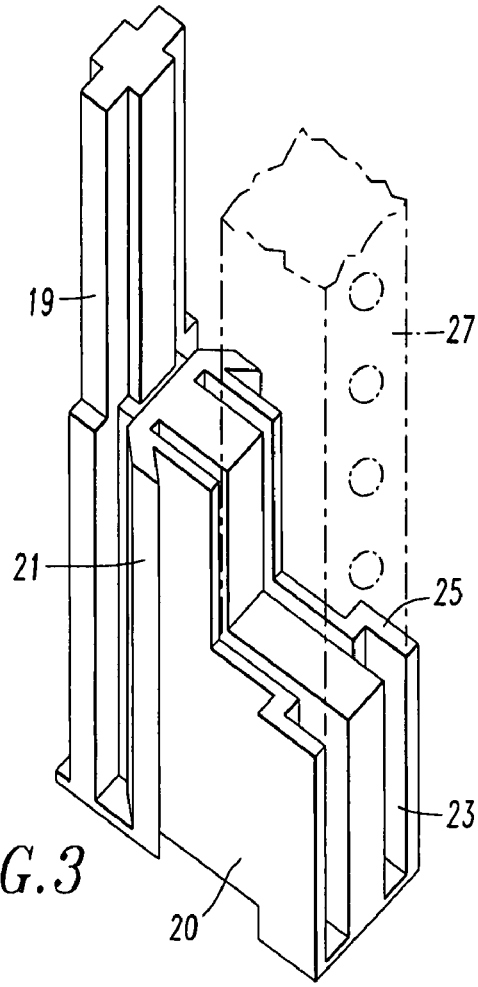
FIG. 3 is a perspective view of a bracket that can be included in the header, footer and bracket pack in the present preferred embodiment of our kit.

Brackets 18 are attached to ends 4 and 6 of header 3 and ends 8 and 12 of footer 5 by screws 20, shown by dotted line in FIG. 2. Each bracket can be a tube having a rectangular or square cross-section. One bracket may extend the full length of the stile, in which case one end of the bracket is attached to the header and the opposite end of the bracket is attached to the footer. Alternatively two shorter brackets can be used with one bracket attached to the header and the second bracket attached to the footer. The two shorter brackets must have a length that is less than half the length of the stile to which they are to be connected. We prefer to use the bracket 18 shown in FIG. 3. This bracket has a first portion 20 that abuts a second longer portion 21 forming a step-like structure. A third portion 19 is thinner and longer than portion 20 and is attached to portion 20. When the bracket is installed surface 23 will abut the end of the header or footer. Surface 25 is a seat for a louver strip 27, shown in broken line in FIG. 5. The louver strip has spaced apart holes which receive pins extending form the louvers. Portions 19 and 21 extend into the stile for greater support.

Figure 4:
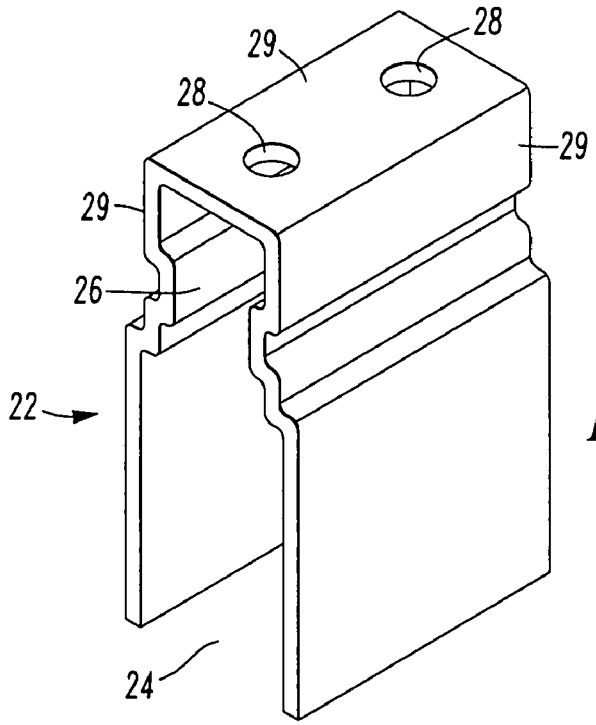
FIG. 4 is a perspective view of a present preferred embodiment of a jig that can be included in our kit.
Figure 5:
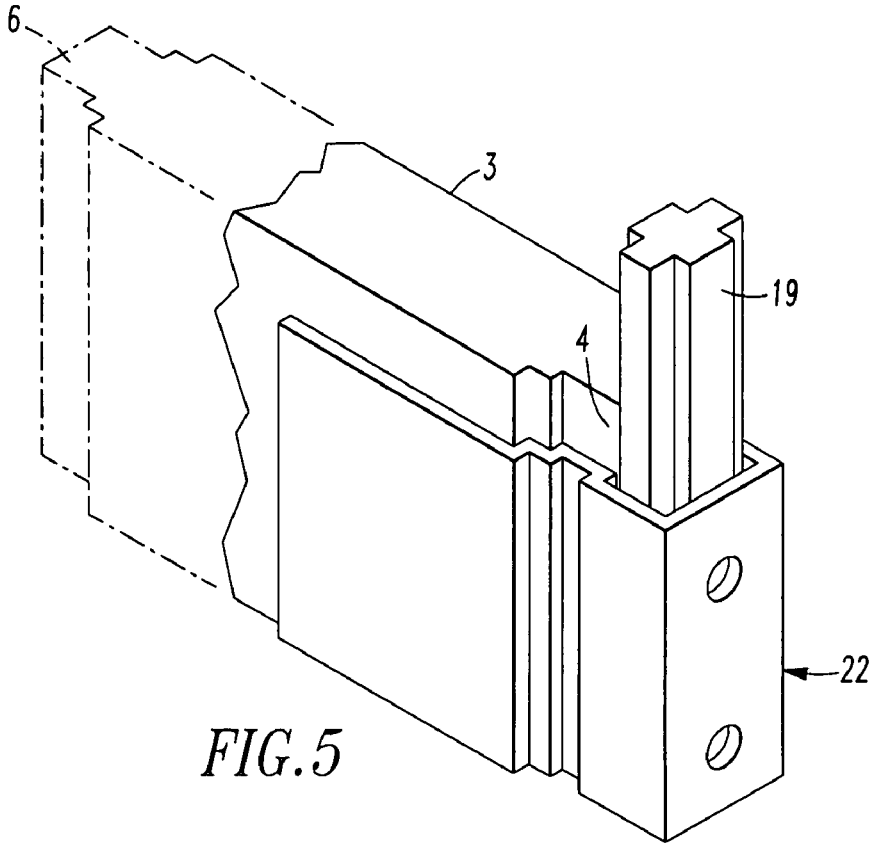
FIG. 5 is a perspective view of a header connected to a present preferred embodiment of the bracket by using the jig shown in FIG. 4.
Figure 8:
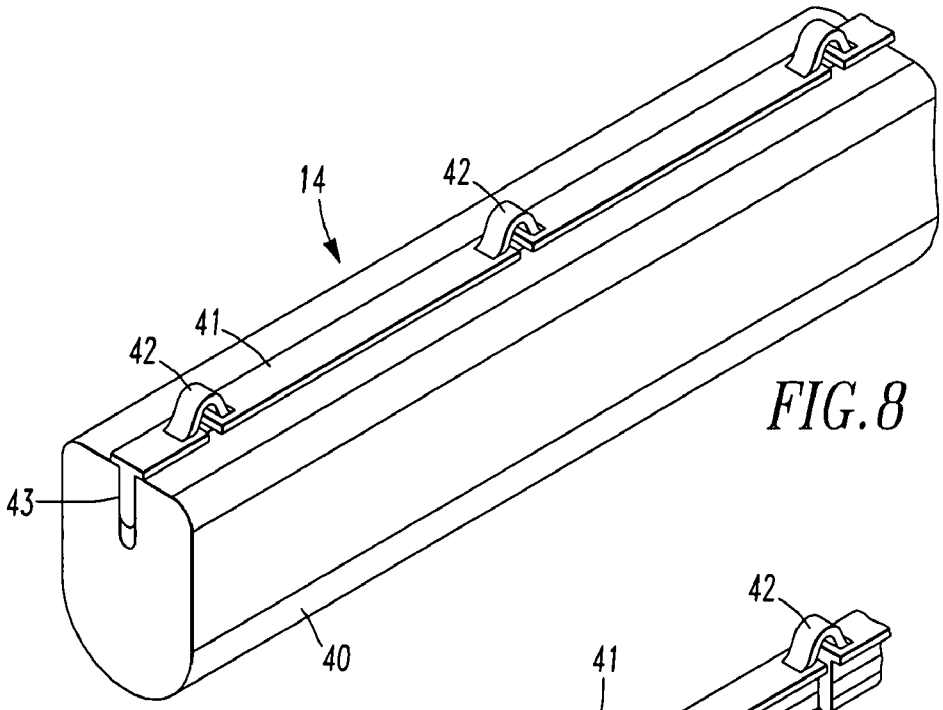
FIG. 8 is a fragmentary view of a present preferred embodiment of a tilt rod having two elongated bodies that can be included in our kit.
Figure 9:
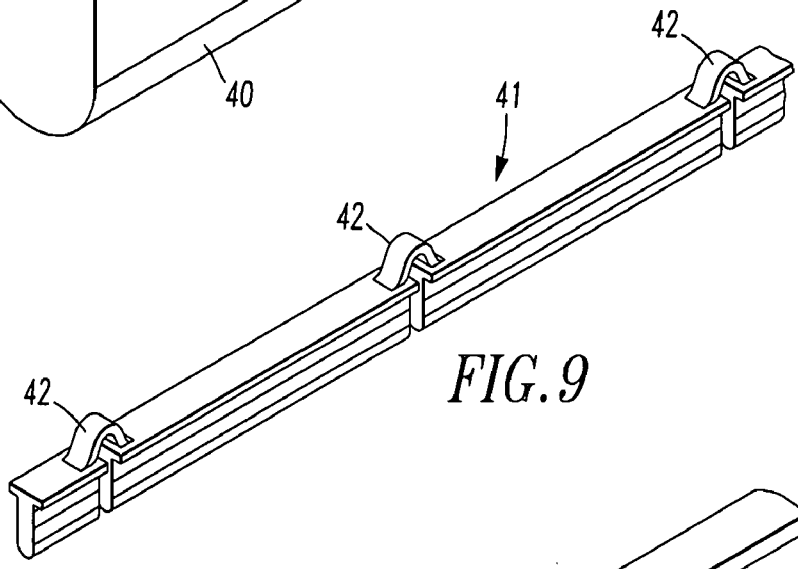
FIG. 9 is a fragmentary view of a present preferred embodiment of the second elongated body which is used in the tilt rod shown in FIG. 8.
Figure 10:
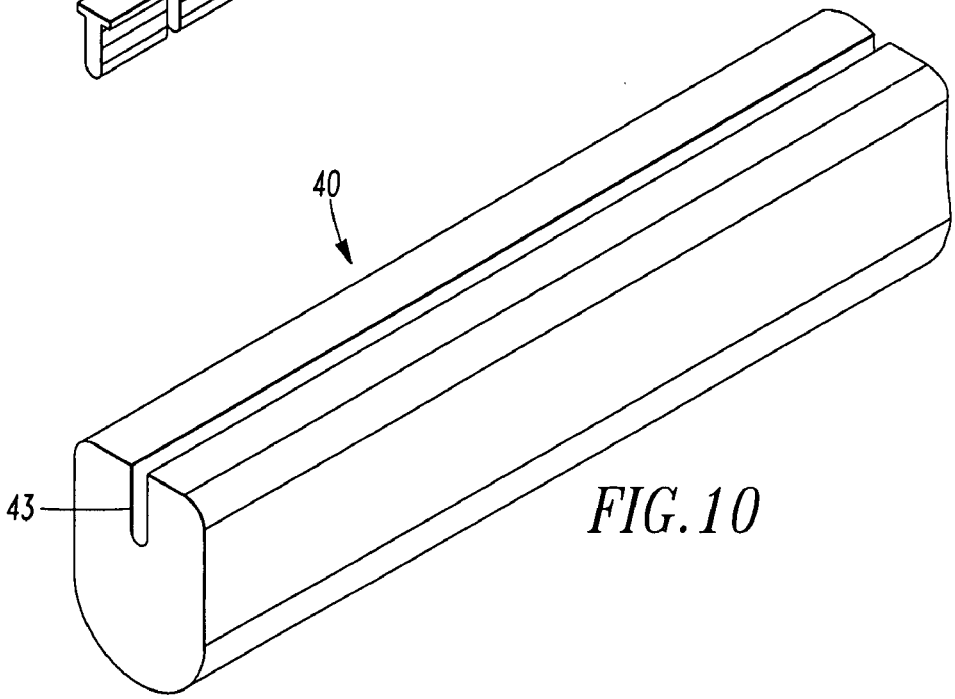
FIG. 10 is a fragmentary view of a present preferred embodiment of a first elongated body which is used in the tilt rod shown in FIG. 8.

We prefer to provide the jig 22 shown in FIGS. 4 and 5 for use in attaching the brackets to the header 3 and footer. The jig 22 has a mouth 24 that is sized and configured to receive an end of the header or footer and a cavity 26 that is defined by sidewalls 29 of the jig. The cavity 26 is adjacent the mouth 24 and is sized and configured to receive either end of each bracket 18. Screw holes 28 may be provided in one of the sidewalls 29 to assure accurate placement of the screws which attach the bracket to the header or footer. The holes are sized to permit a screw to pass through either hole 28 and into the bracket and the header or footer.

A user may insert the bracket into the cavity 26 of the jig and then insert an end of the header or footer into the mouth 24 of the jig, as shown in FIG. 5. When so positioned the bracket and header or footer are properly aligned for attachment to one another. To connect the bracket 18 to the header or footer the user may then insert screws through screw holes 28 and drive those screws into the bracket 18 and header or footer to correctly secure the bracket 18 to the header or footer. Once the screws have been fully tightened, the jig 22 is removed from the bracket 18 and header 3 or footer 5. The user may then use the same jig 22 to similarly attach the other brackets 18 in the kit to the other ends of the header or footer. Use of the jig 22 greatly reduces, if not eliminates, the difficulty many users may experience in attaching a bracket to an end of a header or footer.

The louvers 16 are attached to the stiles by pins 32. The pins 32 may be packed within the pack containing the louvers or packaged and sold separately. The pins 32 are preferably spring loaded and are sized and configured to be held within selected holes in the louver strips. One end of each pin fits within a respective hole, channel or cavity in a louver, as may be best seen in FIG. 6. The opposite end fits within a hole in the louver strip.

In some embodiments, the pins 32 have a tubular body portion 33 that contains a spring 39, which is illustrated by dotted line in FIG. 7, and a retractable portion 34. The retractable portion 34 is positioned adjacent the spring such that the portion 34 may be moved entirely into the tubular body portion 34. The tubular portion 33 or retractable portion 34 may be tapered to have a smaller diameter at the tip. Tapering provides a friction fit with the louver to help ensure that the louvers 16 will stay in any tilted position to which they may be moved. The pin may be oriented so that the tubular body portion is within the louver or so that the tubular body portion is in a hole in the louver strip.

We prefer to provide a tilt rod 14 which has a first elongated body 40 containing a slot 43 and a second elongated body 41 that has a plurality of hooks 42. At least a portion of the second elongated body is sized and configured to fit within the slot 43 in the first elongated body 40 connecting the first elongated body 40 to the second elongated body 41. Each hook 42 is sized, positioned and configured to receive a portion of one of the louvers 16. In some embodiments, the portion of each louver to which each hook is configured to receive may be a staple or loop that is sized and positioned to receive a hook.

It should be appreciated that the hooks 42 of the second body and the size and configuration of the second elongated body permit a user or assembler to connect the tilt rod 14 to the louvers 16 prior to connecting the louvers to the stiles 7 or 9 when assembling the shutter 17. For example, the second elongated body 41 can be connected to the plurality of louvers prior to inserting and connecting the second elongated body 41 to the first elongated body 40. The louvers may then be connected to each stile 7 and 9 while attached to the second elongated body 41. After the louvers have been placed between the stiles, the first elongated body 40 is attached to the second elongated body.

When a shutter panel is installed in a window opening, light gaps may exist due to non-uniform or irregular dimensions of the sides of the window openings or slight inaccuracies made when measuring the window opening dimensions. One or more light block strips 50 may be included in box 2 of the first embodiment 1 of our kit to be connected or fastened to the window frame. In alternative embodiments of our kit, one or more light block strips 50 may be packaged and sold separately.

We prefer to provide the light block strip 50 shown in FIG. 11 which is positioned adjacent the bottom of the shutter panel when the panel is in a closed position and a second light block strip which is positioned adjacent the top of the shutter panel when the panel is in a closed position. Each light block strip has an elongated body 51. The elongated body 51 may have a length that is not longer than a length that equals the length of the footer plus the width of stile 7 plus the width of stile 9. The length of the light block strip may then be cut down to adjust the length in the event the footer or header is cut down. In alternative embodiments, the elongated body 51 may have a length that is not greater than the length of the footer. In that embodiment we prefer to provide a generally U-shaped member that is connected to the elongated body 51. The U-shaped member can overlap a selected portion of the elongated body. By changing the amount of overlap one can adjust the length of the light block strip 50. Preferably the generally U-shaped member 52 has a length equal to or greater than the combined widths of the stiles. One or more magnets 53 may be attached to the elongated body or U-shaped member for use in combination with a small metal plate on a shutter panel to create a magnetic catch. For embodiments that include an elongated body 51 composed of metal or other substance that is attracted by magnets, the magnet or magnets 53 may alternatively be connected to member 52 to fasten the U-shaped member 52 to the elongated body 51. Of course, other fastening devices, such as screws or clips, may also be used to connect member 52 to elongated body 51.

When the user is ready to build and install a shutter panel using the kit we have here described and illustrated we suggest that he or she begin by installing the frame members to opposite sides of the window opening and then build the shutter panel. Building the shutter panel should begin by attaching the brackets to the header and footer. This can be done by using the jig 22 shown in FIG. 4 in the manner illustrated in FIG. 5. After the brackets are attached the stiles are slid over the brackets. We prefer to drive one screw through each bracket to securely hold the bracket and stile together. Then a louver strip is inserted into each stile. At that point the assembly looks like a picture frame with an opening for the louvers. Next the louvers are consecutively installed between the stiles. The second portion of the tilt rod is attached to the louvers such that one hook is in a staple or loop provided on the edge of each louver. Then the first portion of the tilt rod is fitted onto the second portion of the tilt rod completing the shutter panel.

The shutter panel is attached to the frame by hinges. We prefer to sell the stiles and frame pieces with one half of at least two hinges attached. Then the customer can simply align the halves of each hinge and inset a hinge pin to complete the installation.

It should be understood that our kit can be used to sell shutters to homeowners, retailers, or other potential customers. The unassembled shutter components can be offered for sale in kit form such that the footer, header, stiles, frame members, louvers, tilt rod, brackets and jig are all sold separately, sold in packages that only contain one group of shutter components, or sold in various different packages that can be combined to provide the components necessary for assembling a shutter. For example, each separately wrapped group of components, shown in FIG. 1 may be packaged separately and sold separately or in combination with some or all of the other components by a retailer.

In some embodiments, a customer may select different shutter components from different displays or displayed packages of the different shutter components and then be provided with one or more packages containing all the components necessary for assembling a shutter from a retailer. For example, a retailer may provide and display two or more different packages containing stiles 7, 9 having different lengths. The customer may then select one of the different types of stiles that requires the least amount of material to be cut for the stiles to fit within that customer's window opening. Based on this selection and the window opening dimensions provided by the customer, a retailer may then cut the selected stiles down and select the other shutter components that match the selected stile and cut those components down to the appropriate length and width to fit within the customer's window opening. As discussed above, the retailer can cut each component separately or have the different components wrapped to reduce or minimize the number of cuts needed to cut the shutter components down the appropriate dimensions. The retailer may then provide the customer with one or more packages containing all the shutter components needed to be assembled to form the shutter selected by the customer.

The retailer could also pick some or all of the shutter components for the customer based on information, such as window opening dimensions or selected stile, header, footer, tilt rod, or louver or shutter stiles, obtained from a customer and provide the customer with a package containing all the shutter components needed to form a shutter.

A retailer may also offer an embodiment of our kit that contains all the components necessary for assembling a shutter in one package that may then be opened by the retailer to extract the different shutter components that need to be cut down to fit within the window opening dimensions provided by the customer. Of course, different packages may contain components of different length or width dimensions to ensure the shutter components offered for sale by the retailer are able to be installed within most, if not all, window openings a homeowner or customer may have.

In discussing the manner in which the shutter components are assembled, we have described the assembly as having been done by the customer. By having the customer assemble the components the shutter panel can be sold at a lower price. However, some retailers may choose to assemble the shutter components for the customer for an additional fee or offer assembly service from a third party.

The shutter panel and kit for making the shutter panel shown in the drawings has louvers that extend horizontally between the stiles. It should be understood that our kit and method for making and assembling shutters could be used to make a shutter panel in which the louvers extend vertically between the header and the footer.

While we have shown and described certain present preferred embodiments of our kit for making a shutter and have illustrated certain present preferred methods of making and using the kit and shutter panels made from components in the kit, it is to be distinctly understood that the invention is not limited thereto but may be otherwise variously embodied and practiced within the scope of the following claims.

We claim:

1. A kit for making a shutter comprising:

a header having a first end and a second end;

a footer having a first end and a second end;

a plurality of brackets, each bracket sized and configured to be connected to an end of the header or footer;

a first stile and a second stile, each stile having a longitudinal channel that is sized and configured to receive at least a portion of at least one bracket of the plurality of brackets;

a plurality of louvers, each louver of the plurality of louvers sized and configured to be connected to and between the first stile and the second stile; and a jig having a body configured to have a mouth sized to receive one end of the header or one end of the footer as selected by a user, the body also having a cavity defined by a plurality of sidewall portions of the body, the cavity being adjacent the mouth the jig used to align the header or footer and bracket during assembly such that a user of the jig can place one end of one of the brackets in the cavity and one end of the header or footer in the mouth and connect the bracket to the header or footer that is in the mouth while the bracket and header or footer are in the jig without connecting the jig to the header, the footer, or any of the plurality of brackets such that the jig does not become part of an assembled shutter; and wherein the jig separate from the shutter and is not a component of the shutter after assembly.

2. The kit of claim 1 wherein one of the plurality of sidewall portions of the jig has at least one screw hole positioned to enable a user to connect the bracket in the cavity to the header or footer in the mouth by passing a screw through the screw hole and into the bracket in the cavity to the header or footer in the mouth.

3. The shutter kit of claim 1 wherein each of the plurality of louvers has a pin at each end and at least one pin on each louver is spring loaded.

4. The kit of claim 3 wherein each spring loaded pin has a tubular body portion containing a spring and a retractable portion which is positioned adjacent the spring such that the retractable potion is able to move into the tubular body portion.

5. The kit of claim 4 and wherein the tubular body portion is tapered.

6. The kit of claim 4 and wherein the retractable portion is tapered.

7. The kit of claim 1 further comprising a light block strip.

8. The kit of claim 7 wherein the footer has a length, the stiles have a width and the light block strip has a length which is not greater than the length of the footer plus the widths of the stiles.

9. The kit of claim 8 wherein the light block strip is comprised of an elongated body having a length equal to the length of the footer and an elongated U-shaped member sized to fit over the elongated body, the U-shaped member having a length equal to the sum of the widths of the stiles.

10. The kit of claim 7 further comprising at least one magnet attached to the light block strip.

11. The kit of claim 1 also comprising a tilt rod configured for attachment to the plurality of louvers.

12. The kit of claim 11 wherein the tilt rod comprises a first elongated body having a slot and a second elongated body, at least a portion of the second elongated body being sized and configured to fit within the slot of the first elongated body, the second elongated body having a plurality of hooks, each hook being sized, positioned and configured to receive a portion of one of the louvers of the plurality of louvers.

13. The kit of claim 12 wherein each of the plurality of louvers has a loop sized and positioned to receive one of the hooks in the second elongated body.

14. The kit of claim 1 wherein the stiles are wrapped together in a manner so that both stiles can be cut simultaneously.

15. The kit of claim 1 wherein the header and the footer are wrapped together in a manner so that the header and the footer can be cut simultaneously.

16. The kit of claim 1 wherein the header, footer and brackets are packaged in one pack and the stiles and louvers are packaged in a separate second pack.

17. The kit of claim 16 also comprising at least one of louver strips, a tilt rod, frame pieces, and screws packaged in the second pack.

* * * * *